US009770637B2

(12) United States Patent
Cranford

(10) Patent No.: US 9,770,637 B2
(45) Date of Patent: Sep. 26, 2017

(54) WORD FORMING BALL GAME AND TARGET MIXER

(71) Applicant: Aim 4 Pie, LLC, Arab, AL (US)

(72) Inventor: Carol Johnson Cranford, Arab, AL (US)

(73) Assignee: Aim 4 Pie, LLC, Arab, AL (US)

( * ) Notice: Subject to any disclaimer, the term of this patent is extended or adjusted under 35 U.S.C. 154(b) by 59 days.

(21) Appl. No.: 14/615,157

(22) Filed: Feb. 5, 2015

(65) Prior Publication Data

US 2015/0217185 A1 Aug. 6, 2015

Related U.S. Application Data

(60) Provisional application No. 61/936,142, filed on Feb. 5, 2014.

(51) Int. Cl.

| | |
|---|---|
| ***A63F 3/00*** | (2006.01) |
| ***A63B 67/00*** | (2006.01) |
| ***A63B 67/06*** | (2006.01) |
| ***A63F 3/04*** | (2006.01) |
| ***A63F 11/00*** | (2006.01) |
| *A63B 69/00* | (2006.01) |
| *A63B 71/06* | (2006.01) |
| *A63B 43/00* | (2006.01) |

(Continued)

(52) U.S. Cl.

CPC ..... *A63B 67/002* (2013.01); *A63B 67/06* (2013.01); *A63F 3/00529* (2013.01); *A63F 3/0423* (2013.01); *A63F 11/0002* (2013.01); *A63B 43/008* (2013.01); *A63B 47/00* (2013.01); *A63B 69/0053* (2013.01); *A63B 71/0672* (2013.01); *A63B 2063/001* (2013.01); *A63B 2071/0602* (2013.01); *A63B 2071/0694* (2013.01); *A63B 2208/12* (2013.01); *A63B 2209/10* (2013.01); *A63B 2210/50* (2013.01); *A63F 2001/0458* (2013.01); *A63F 2003/00798* (2013.01); *A63F 2003/0426* (2013.01)

(58) Field of Classification Search

CPC .. A63F 3/00; A63F 3/0423; A63F 2003/0078; A63F 3/00529; A63F 11/0002; A63F 2001/0458; A63F 2003/0426; A63B 67/002; A63B 67/06; A63B 69/0053; A63B 71/0672; A63B 43/008; A63B 47/00; A63B 2063/001; A63B 2073/0602; A63B 2073/6094; A63B 2208/12; A63B 2209/10; A63B 2210/50

USPC ..... 273/272, 144 R, 144 A, 144 B, 145 R, 273/145 A, 145 B, 145 D, 145 E, 317.3, 273/348, 407; 473/197, 435, 446, 476, 473/478

See application file for complete search history.

(56) References Cited

U.S. PATENT DOCUMENTS

| | | | |
|---|---|---|---|
| 1,084,370 | A | 1/1914 | Smith |
| 1,326,695 | A | 12/1919 | Schwarz |

(Continued)

*Primary Examiner* — William Pierce

(74) *Attorney, Agent, or Firm* — Ann I. Dennen; Lanier Ford Shaver & Payne PC

(57) ABSTRACT

The present disclosure is a game that has a mixer positioned at a first location on a gaming area and a plurality of balls randomly dispersed throughout the gaming area. In response to a command, a player on a team collects one or more of the plurality of balls, the score is incremented based upon the balls collected, the player throws the collected ball(s) into the mixer, and the mixer disperses the ball(s) back into the gaming area.

10 Claims, 5 Drawing Sheets

(51) Int. Cl.

| | |
|---|---|
| *A63B 47/00* | (2006.01) |
| *A63B 63/00* | (2006.01) |
| *A63F 1/04* | (2006.01) |

(56) References Cited

U.S. PATENT DOCUMENTS 1,538,455 A 10/1924 Winkel
1,765,625 A 11/1928 Snover
1,929,329 A 8/1932 Murray
2,017,473 A 11/1934 Reimert
2,175,939 A 1/1937 Grudin
2,218,375 A * 10/1940 Solomon ..... A63F 7/0017 273/120 R
2,805,069 A 10/1955 Bonari et al.
2,900,742 A 4/1956 Barker et al.
3,063,164 A 11/1959 Pellegrino et al.
2,960,794 A 11/1960 Johns
3,422,549 A 1/1969 Grangaard
3,423,872 A 1/1969 Dodson
3,427,028 A 2/1969 Abrahamsen
4,004,811 A * 1/1977 Brandin ..... A63F 7/048 273/144 A
4,055,348 A 10/1977 Marzoni, Jr.
4,665,935 A * 5/1987 Nichols ..... E04H 15/425 135/116
4,867,450 A * 9/1989 Katz ..... A63B 43/008 473/459
4,934,711 A * 6/1990 Runstein ..... A63F 3/0423 273/272
5,054,788 A * 10/1991 Kirby ..... A63F 3/0423 273/272
5,106,103 A * 4/1992 Fiore ..... A63F 9/0098 273/145 C
5,230,518 A * 7/1993 Crowe ..... A63F 3/0423 273/299
5,328,173 A * 7/1994 Stern ..... A63F 7/048 273/144 B
5,393,049 A * 2/1995 Nelson ..... A63B 63/08 273/396
5,603,504 A 2/1997 Powell
5,615,887 A * 4/1997 Park ..... A63F 9/0098 273/272
5,632,490 A * 5/1997 Brown ..... A63F 7/048 273/138.3
5,673,914 A * 10/1997 Sullivan ..... A63F 7/048 273/138.1
5,681,230 A * 10/1997 Krings ..... A63B 69/0071 124/26
5,722,446 A * 3/1998 Zheng ..... A63B 63/08 135/116
5,769,421 A 6/1998 Wakefield
5,813,672 A 9/1998 Loud, Jr.
6,082,386 A * 7/2000 Zheng ..... A63B 9/00 135/119
6,089,570 A 7/2000 Gruber
6,142,890 A * 11/2000 Craig ..... A63B 67/002 273/394
6,152,448 A * 11/2000 Cudlipp ..... G07C 15/001 273/144 A
6,224,503 B1 * 5/2001 Joseph ..... A63B 63/083 124/6
6,319,145 B1 * 11/2001 Coughlan ..... A63B 63/00 273/407
6,328,050 B1 * 12/2001 McConnell ..... E04H 15/40 135/116
6,378,868 B1 4/2002 La Bassiere
6,379,272 B1 * 4/2002 Gorgo ..... A63B 71/022 273/407
6,554,278 B1 4/2003 Haddox
6,682,074 B2 1/2004 Weston
6,685,477 B1 2/2004 Goldman et al.
6,761,642 B2 * 7/2004 Ye ..... A63D 15/00 273/123 R
6,769,692 B1 * 8/2004 Cavalluzzo ..... A63F 3/0423 273/272
6,966,556 B1 11/2005 Culley et al.
7,044,467 B1 * 5/2006 Dimmig ..... A63F 3/04 273/272
7,731,198 B2 * 6/2010 Cho ..... A63B 63/00 273/396
7,891,665 B1 * 2/2011 Nathanson ..... A63F 3/00895 206/315.1
7,954,504 B2 * 6/2011 Price ..... E04H 15/425 135/119
8,387,985 B1 * 3/2013 Itkis ..... G07C 15/001 273/144 B
8,480,503 B2 7/2013 Wilbur et al.
8,556,264 B2 10/2013 Benedict, III
8,567,787 B1 10/2013 Chang
8,662,896 B2 * 3/2014 Theriault ..... G09B 19/00 434/156
2002/0084588 A1 * 7/2002 Lynch ..... A63B 63/00 273/343
2005/0230914 A1 * 10/2005 Campbell ..... A63F 9/0001 273/272
2005/0285338 A1 * 12/2005 Cusolito ..... A63F 3/0423 273/146
2006/0022407 A1 * 2/2006 Jensen ..... A63F 3/04 273/272
2007/0187898 A1 * 8/2007 Chang ..... A63B 63/00 273/407
2008/0032827 A1 * 2/2008 Behrend ..... A63B 69/002 473/446
2008/0187890 A1 * 8/2008 Podurgiel ..... A63F 1/00 434/129
2008/0311546 A1 12/2008 Wang
2009/0191520 A1 7/2009 Viriyala
2010/0013159 A1 1/2010 Lin
2010/0113190 A1 * 5/2010 Vysosias ..... A63B 63/08 473/481
2010/0264586 A1 * 10/2010 Mifflin ..... A63F 3/0423 273/272
2011/0193290 A1 8/2011 Sullivan
2012/0094259 A1 4/2012 Lipsky et al.
2012/0295235 A1 11/2012 Theriault
2013/0045815 A1 * 2/2013 Cho ..... A63B 63/00 473/197
2013/0225254 A1 8/2013 Pececnik et al.
2013/0273511 A1 10/2013 Terpstra et al.
2013/0292903 A1 11/2013 Anderson
2014/0084540 A1 * 3/2014 Hedgecock ..... A63F 3/0423 273/272
2014/0084541 A1 * 3/2014 Hedgecock ..... A63F 3/00634 273/272
2016/0063788 A1 * 3/2016 Trahan ..... G07C 15/001 273/144 A

* cited by examiner

WORD FORMING BALL GAME AND TARGET MIXER

CROSS REFERENCE TO RELATED APPLICATION

This application claims priority to U.S. Provisional Patent Application Ser. No. 61/936,142 entitled Physical And Academic Game and filed on Feb. 5, 2014, which is incorporated by reference in its entirety.

BACKGROUND

Many elementary age children take physical education as part of their academic curriculum. In this regard, throughout a typical school day of a child he/she has a physical education (also referred to as "PE") class intermixed with his/her academic classes.

Typical PE classes focus entirely on physical activities that help a child learn the skills to be active in life. For example, PE classes teach fundamental locomotor skills, such as walking, running, hopping, jumping and skipping. In addition PE classes may also focus on nonlocomotor skills such as turning, twisting, swinging, balancing and bending. Addition physical activities in PE class may focus on teaching manipulative skills, such as catching, dribbling, throwing, or kicking. Other types of activities may include those directed toward improving gross/fine motor skills, eye hand coordination, spatial awareness, and agility/balance.

SUMMARY

The present disclosure is a game that has a mixer positioned at a location on a gaming area and a plurality of balls randomly dispersed throughout the gaming area. In response to a command, a player on a team collects one or more of the plurality of balls, the score is incremented based upon the balls collected, the player throws the collected ball(s) into the mixer, and the mixer disperses the ball(s) back into the gaming area.

DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DESCRIPTION

The present disclosure related to a physical and academic game that effectively integrates academic skills, e.g., reading and spelling, into basic physical skills. In this regard, the physical and academic game comprises a mixer goal that is placed in the middle of a playing area, e.g., a gym, a school yard, or other indoor or outdoor physical education arenas. Balls inscribed with letters of the alphabet are placed in proximity to the mixer goal. Children playing the game are tasked with building words from balls inscribed with letters of the alphabet. In order to perpetuate the game, once a child (or group of children, e.g., a team) have built the tasked word, the children throw the balls making up the word into the mixer goal, and the mixer goal disperses the balls back into the playing area.

Figure 1:
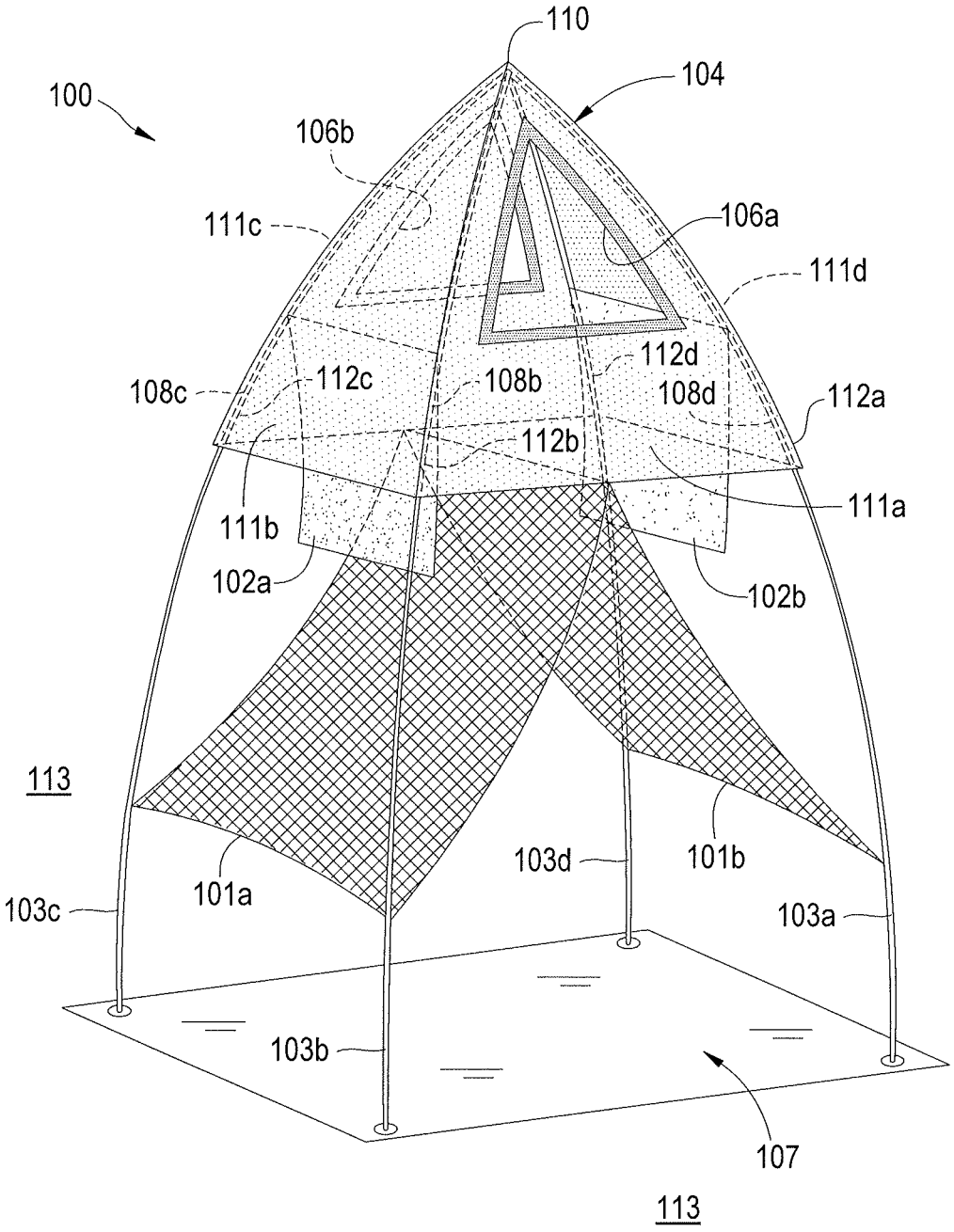
FIG. 1 is an isometric view of an exemplary mixer in accordance with an embodiment of the present disclosure.

FIG. 1 depicts a mixer goal 100 in accordance with an embodiment of the present disclosure. The mixer goal 100 comprises a floor mat 107, four flexible poles 103*a*-103*d*, a ball receiver and disperser 104, and ball dispersion ramps 101*a*-101*b*.

In the embodiment shown, the floor mat 107 is a substantially square piece of fabric. However, the floor mat 107 may be other shapes and made of other types of materials in other embodiments. The floor mat 107 rests upon a gaming area 113, which can be, for example, a gym floor or a playground yard.

In the embodiment depicted, the four flexible poles 103*a*-103*d* are flexibly and removeably coupled to the floor mat 107. In this regard, the floor mat 107 may have openings and/or stops integrated therein to retain the poles 103*a*-103*d* with respect to the floor mat 107. Note that the floor mat 107 may not be used in other embodiments of the present disclosure. In this regard, the ends of each pole 103*a*-103*d* may comprise feet (not shown) coupled thereto that retain the poles in the positions shown in FIG. 1.

The poles 103*a*-103*d* are inserted through casings 108*a*-108*d*, respectively. Each of the casings 108*a*-108*d* is a fabric channel of the ball receiver and disperser 104 through which the poles 103*a*-103*d* may be inserted. Note that when the poles 103*a*-103*d* are inserted within the casings 108*a*-108*d*, the poles 103*a*-103*d* bend such that the mixer 100 stands upright. Further, in bending the poles 103*a*-103*d* create a point 110 of the ball receiver and disperser 104.

In the embodiment depicted, the ball receiver and disperser 104 is a pyramidal shape having four faces 111*a*-111*d*. Note that the ball receiver and disperser 104 may be other shapes in other embodiments. For example, the ball receiver and disperser 104 may be rectangular or square.

The ball receiver and disperser 104 further comprises openings 106*a* and 106*b*, respectively. In the embodiment depicted, the openings 106*a* and 106*b* are triangular. However, the openings 106*a* and 106*b* may be other shapes in other embodiments, e.g., circular, square, etc. Further, the ball receiver and disperser 104 is coupled to flaps 102*a* and 102*b*. In one embodiment, the flaps 102*a* and 102*b* are sewn to the seams 112*a*, 112*b* and 112*c*, 112*d*, respectively. The flaps 102*a* and 102*b* are positioned such that a portion of each flap hangs below the ball receiver and disperser 104.

Further, the mixer 104 comprises the ball dispersion ramps 101*a* and 101*b*. Note that in the embodiment depicted in FIG. 1, the ball dispersion ramps 101*a* and 101*b* are made of an open-meshed material, i.e., netting. However, the dispersion ramps 101*a* and 101*b* may be made of other types of materials in other embodiments.

The mixer 100 is used in a game, the rules and details for which are described further herein. Notably, during the game, a ball (not shown) is thrown into one of the openings 106*a* or 106*b*. The ball then falls through the force of gravity toward the ramps 101*a* and 101*b*. The flaps 102*a* and 102*b* create a barrier for the ball. In this regard, the flaps 102*a* and 102*b* ensure that the ball thrown is directed toward either ramp 101*a* or ramp 101*b* such that the ball thrown is dispersed into the gaming area 113. In this embodiment, the ball rolls downward on one of the ramps 101*a* or 101*b* and is launched from the mixer 100 to the gaming area 113.

Figure 2:
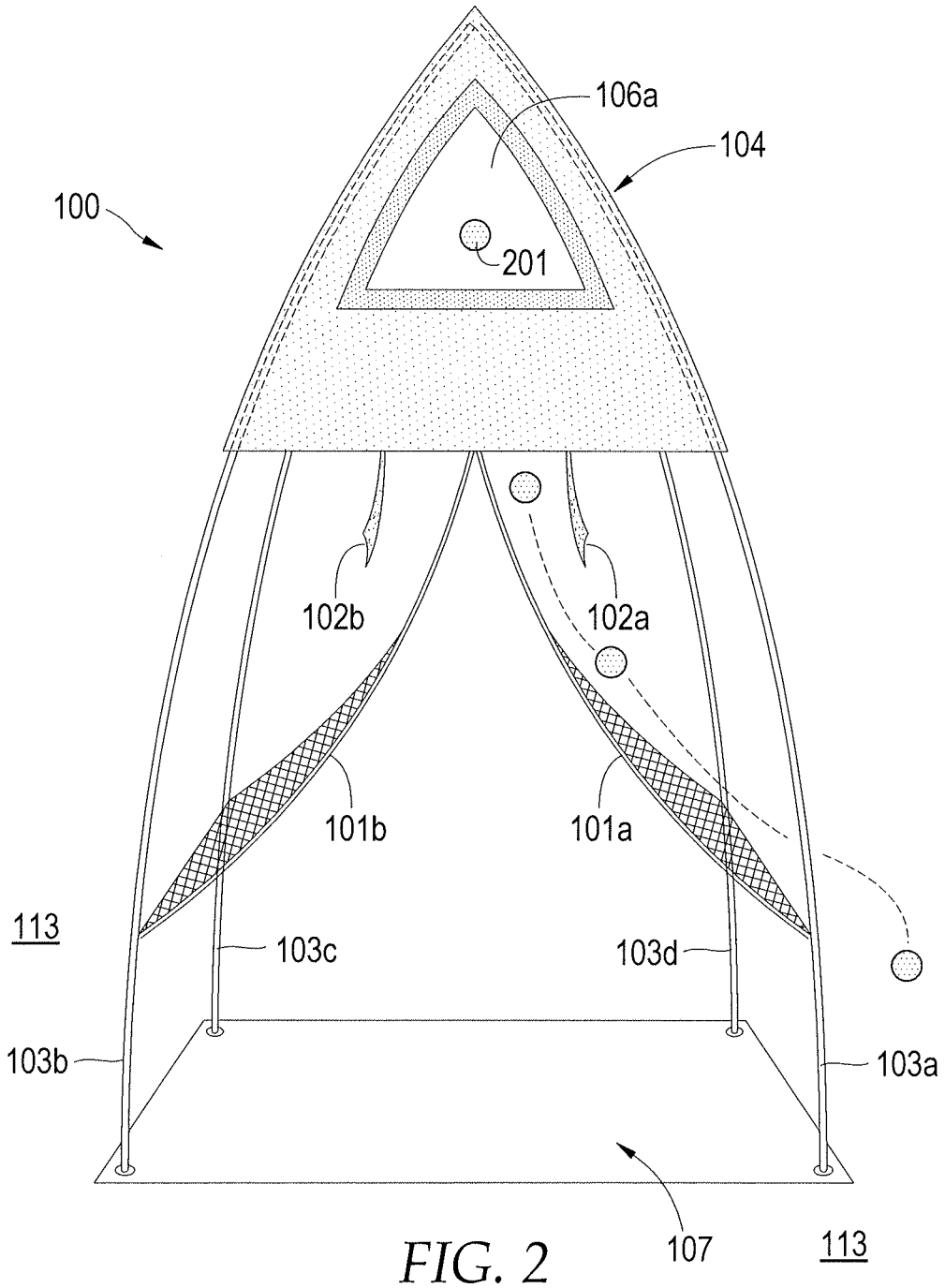
FIG. 2 is a side isometric view of the mixer depicted in FIG. 1.

FIG. 2 is a side view of the mixer 100 to further show an exemplary structure of the mixer 100. The side view of the mixer 100 of FIG. 2 shows a ball being received in the opening 106*a* and being dispersed onto the gaming area 113.

In this regard, the ball receiver and disperser 104 receives a ball 201 through the opening 106*a*. The ball 201 falls through the force of gravity, and the flap 102*a* or 102*b* directs the ball 201 down the respective ramp 101*a* or 101*b*, which in FIG. 1 shows the ball being directed by 102*a* down ramp 101*a*. The ball 201 rolls down the ramp 101*a* and is launched by the ramp 101*a* onto the gaming area 113.

Figure 3:
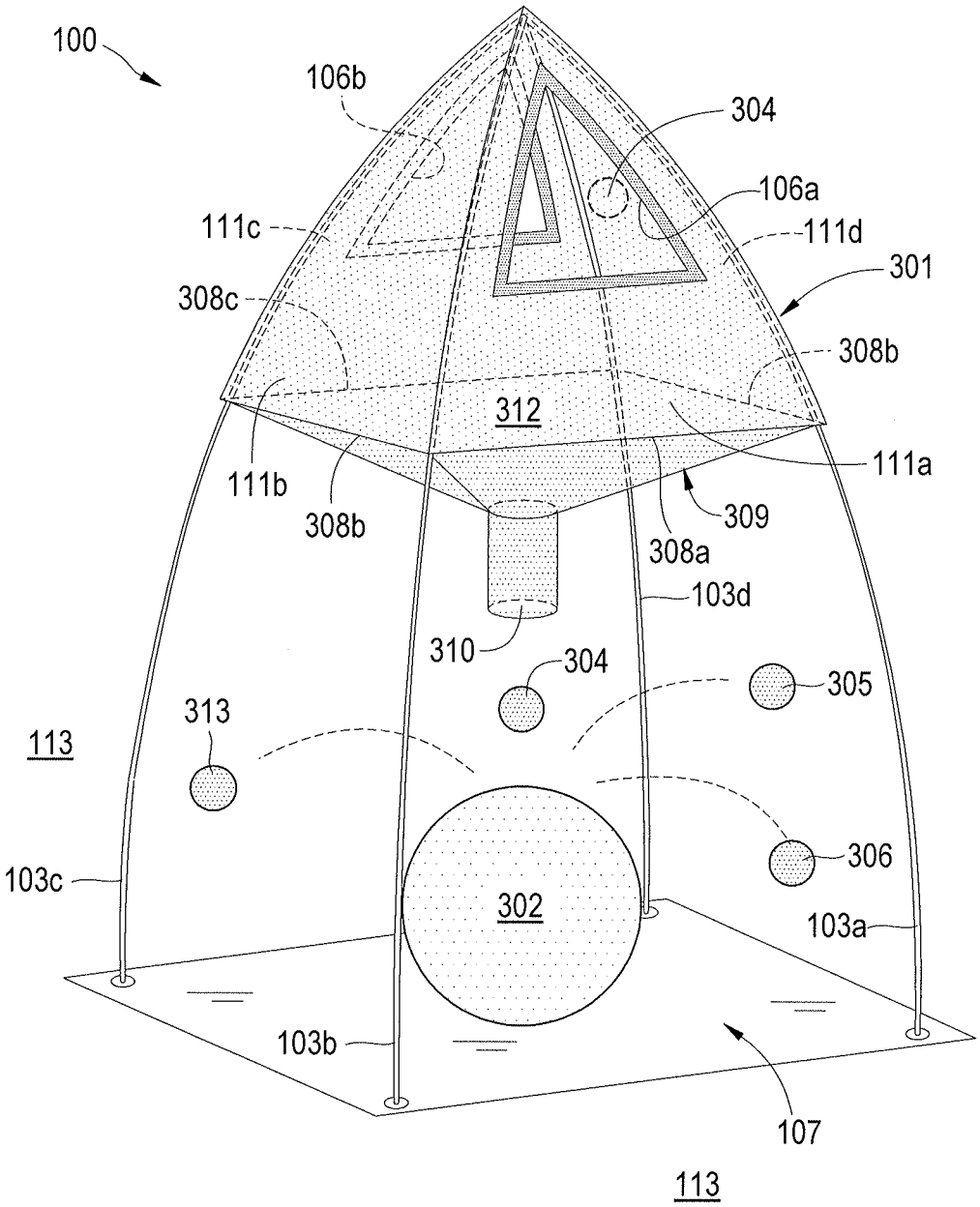
FIG. 3 is an isometric view of another exemplary mixer in accordance with an embodiment of the present disclosure.

FIG. 3 depicts another embodiment of the mixer 100. In the embodiment, the mixer 100 comprises the floor mat 107, four flexible poles 103*a*-103*d*, a ball receiver and disperser 301, and a dispersion ball 302.

In the embodiment shown, the floor mat 107 and the poles exhibit the same structure and function as the embodiment depicted in FIG. 1; however, coupled to the floor mat 107 is a dispersion ball 302, which is described further herein. The dispersion ball 302 may be coupled to the mat 107 via Velcro® or some type of adhesive.

In the embodiment depicted, the ball receiver and disperser 306 is a pyramidal shape having the four faces 111*a*-111*d*. Note that the ball receiver and disperser 301 may be other shapes in other embodiments. For example, the ball receiver and disperser 301 may be rectangular or square.

The ball receiver and disperser 301 further comprise the openings 106*a* and 106*b*, respectively. In the embodiment depicted, the openings 106*a* and 106*b* are triangular. However, the openings 106*a* and 106*b* may be other shapes in other embodiments, e.g., circular, square, etc. Further, the ball receiver and disperser 301 is coupled to a funnel 309. In one embodiment, the funnel 309 is sewn to the seams 308*a*-308*d*. The funnel 309 is further coupled to a tube 310.

The mixer 100 is used in a game, the rules and details for which are described further herein. Notably, during the game, a ball 304 is thrown into one of the openings 106*a* or 106*b*. The ball then falls through the force of gravity toward the funnel 309. The ball 304 rolls along the inside surface 312 of the funnel 309, which directs the ball 304 to the tube 310.

The ball 304 falls through the tube through the force of gravity, and lands on the dispersion ball 302. The ball 304 bounces off the dispersion ball 302, and the ball 304 is dispersed to the gaming area 113. The dispersion of the ball 304 to the gaming area 113 is random and is based on the position at which the ball 304 strikes the dispersion ball 302.

Figure 4:
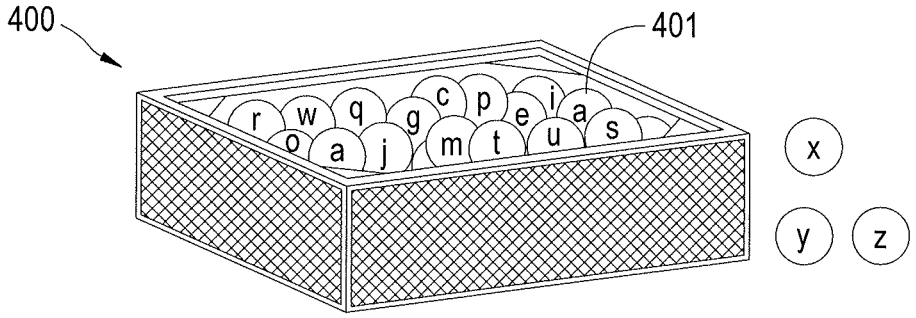
FIG. 4 is an isometric view of an exemplary basket of lettered balls in accordance with an embodiment of the present disclosure used in playing a game incorporating the mixers of FIG. 1 or FIG. 3.

FIG. 4 depicts a basket 400 in accordance with an embodiment of the present disclosure. The basket 400 comprises a set of balls 401. Each ball 401 is inscribed with a particular letter. Note that the balls are removeable from the basket 400. As will be described further herein, a subset of the balls may be used to form words.

Figure 5:
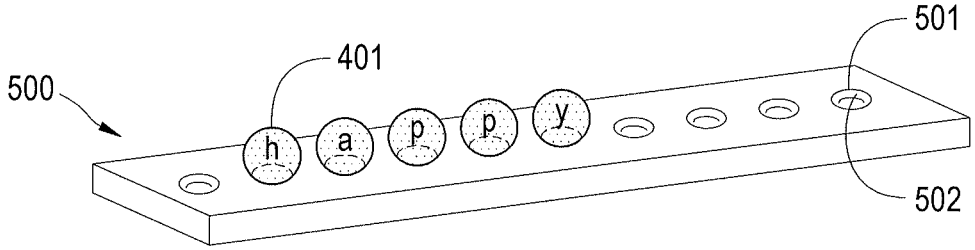
FIG. 5 is an isometric view of an exemplary builder tray in accordance with an embodiment of the present disclosure used in playing a game incorporating the mixers of FIG. 1 or FIG. 3.

FIG. 5 is an isometric view of an exemplary builder tray 500 in accordance with an embodiment of the present disclosure. The builder tray 500 comprises a plurality of openings 501 that comprise a circumferential edge 502. A letter ball 401 is placed upon the circumferential edge 502 of the opening 501, and the ball 401 is retained by the builder tray 500. In this regard, a plurality of balls 401 may be placed on the circumferential edges 502 of adjacent openings 501 to form a word. In the example shown in FIG. 5, the word is "happy."

Figure 6:
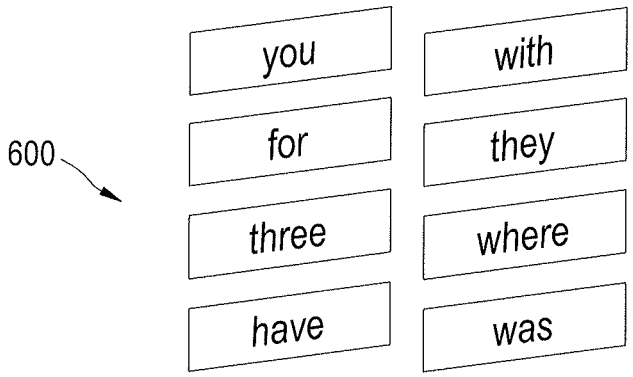
FIG. 6 depicts an exemplary set of task cards that may be used in playing a game incorporating the mixers of FIG. 1 or FIG. 3.

FIG. 6 depicts a set of task cards 600. With reference to FIG. 5, balls 401 corresponding to the letters of a word exhibited on one of the set of cards 600 may formed on the builder tray 500 (FIG. 5).

Figure 7:
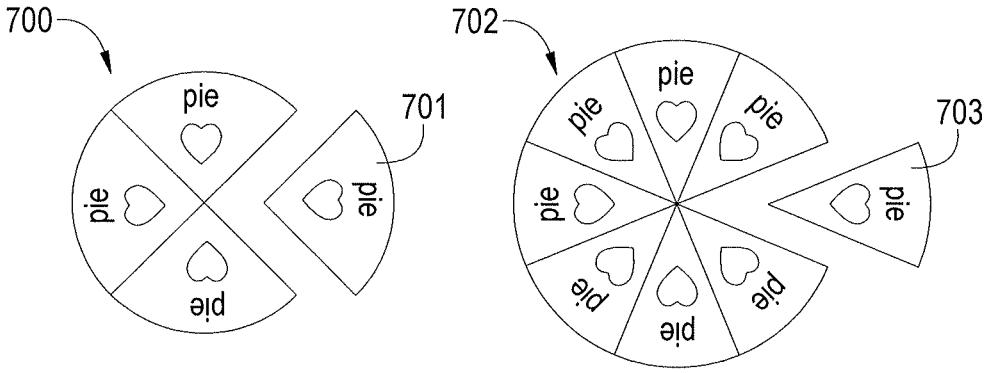
FIG. 7 depicts an exemplary set of point indicator pieces used to keep score in a game incorporating the mixers of FIG. 1 or FIG. 3.

FIG. 7 depicts point indicators 700 and 703. The exemplary point indicators 700 and 703 shown are circular-shaped and representative of a pie. The point indicator 700 comprises four pieces 701, and the point indicator 701 comprises eight pieces 703. Each of the pieces has indicium thereon. In the exemplary pieces shown, the indicia comprise the word "pie" and a graphical heart. Note that as will be described herein, the pieces 701 or 703 are collected by players of a game of the present disclosure to indicate scoring.

Figure 8:
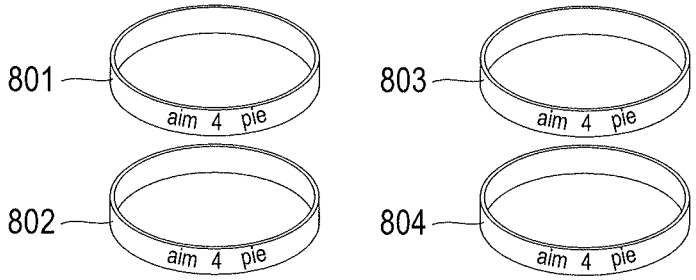
FIG. 8 depicts exemplary wrist bands for identifying players in a game incorporating the mixers of FIG. 1 or FIG. 3.

FIG. 8 depicts a set of wristbands 801-804. The wristbands 801-804 may be word by players of an exemplary game of the present disclosure to indicate the respective players' functions in the game. In this regard, the wristbands 801-804 may be colored, e.g., red and yellow to identify a team and/or the role of the player wearing the wristband 801-804 in the game.

Figure 9:
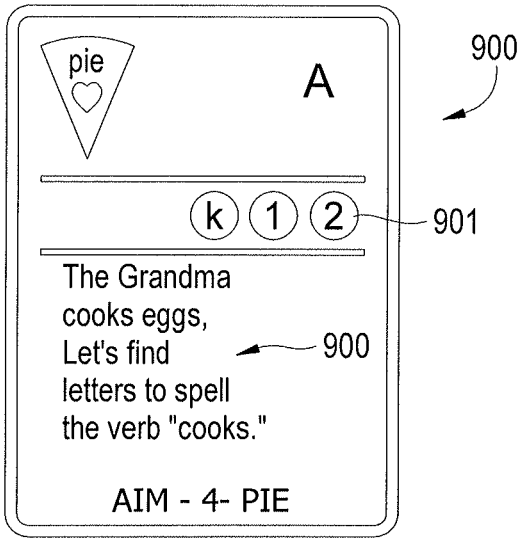
FIG. 9 depicts another exemplary task card that may be used in a game incorporating the mixers of FIG. 1 or FIG. 3.

FIG. 9 depicts another embodiment of a task card 900 in accordance with the present disclosure. The task card 900 may comprise and indicator 901 that identifies the grade level for the particular card. In addition, the card may comprise indicium 902 that provides instructions to a team of a game of the present disclosure. In the example, the task card 900 instructs the team to spell the word "cooks."

With reference to the previous described figures, an exemplary game in accordance with the present disclosure will now be described. The game description following shall assume only two teams for ease of explanation and discussion. However, any number of teams may play the game of the present disclosure in other embodiments.

During set up of the game, a player or instructor (i.e., a teacher) places a mixer 100 (FIG. 1) in a central location (not shown) of the gaming area 113 (FIG. 1). Additionally, balls 401 (FIG. 4) are scattered and dispersed manually throughout the gaming area.

Further, the point the point indicator pieces 701 (FIG. 7) and the task cards 600 (FIG. 6) or 900 (FIG. 9) are placed in a designated area. Note that for a game having two teams, if the point indicator 700 is used, there is available eight pieces 701 (or 16 pieces if the point indicator 703 (FIG. 7) is used). Eight pieces total ensures that there are in game play enough pieces for each team to form a complete point indicator 700. In the example provided herein, the pieces 701 form a complete circle, as described with reference to FIG. 7.

Further note that the task cards 600 (FIG. 6) or task cards 900 (FIG. 9) may be placed at a particular position in the gaming area. Each set of task cards 600 or 900 placed in the gaming area may identify a particular, e.g., with a number identifier card may correlate a team playing the game with a particular number.

Additionally, builder trays 500 (FIG. 5) are placed at separate and distinct positions on the gaming area 113. Note that in playing the game, each identified team has a designated builder tray 500.

A plurality of players (not shown) is divided into teams. In the embodiment described herein, the game is described using two teams wherein each team comprises six players. However, each team may consist of any number of players in other embodiments, and there may be more than two teams in other embodiments. Thus, for the two teams created there are eight point indicator pieces available for retrieval and two sets of task cards (each set having an identifier that identifies the team associated with the set) in the gaming area.

Further, the wristbands 801-804 are worn by a subset of the players. In this regard, each team has a captain player and a point guard player, and each captain/point guard wears identifying wristband, e.g., the captain may wear a red wristband whereas the point guard may wear a yellow wristband. The other players on each team are referred to as "letter ninjas" herein.

When the game begins, the captain retrieves a task card 600 or 900 from the set of task cards identified for his/her team. The captain places the retrieved task card 600 or 900 next to the builder tray placed for his/her team. The task card 600 or 900, as described herein, identifies a word that the team is to spell in its builder tray 500.

The letter ninjas travel around the gaming area 113 looking for one or more balls 401 (FIG. 4) inscribed with letters contained in the word identified on the task card 600 and 900. In one embodiment, the captain may give instructions to each of the letter ninjas instructing him/her to find and retrieve a ball inscribed with a particular letter.

As the letter ninjas bring the balls 401 to the builder tray, he/she places the retrieved letter on the opening 501 associated with the letter position in the work. In another embodiment, the letter ninja may give the ball 401 to the captain, and the captain builds the word in the builder tray 500.

Once the letter ninjas have retrieved all letters in the word indicated by the task card 600 or 900 retrieved, the point guard travels to the point indicator pieces and retrieves one piece 701 (FIG. 7). The team then begins to build his/her point indicator shape, e.g., a circular shape that may be designated as a "pie."

Once the word is spelled on the builder tray 500 and the point indicator piece 701 collected, the letter ninjas retrieve the balls 401 from the builder tray 500. The letter ninjas travel to the mixer 100 (FIG. 1), and each letter ninja throws his/her ball into the mixer 100. The mixer 100 receives and disperses the balls 401 back into the gaming area 113.

The teams race against one another to build its complete point indicator 700, e.g., retrieve and position four pieces of the circular shaped point indicator to form a complete circle. In this regard, each team continues to build words identified by the task cards 600 or 900 until the team has a complete point indicator 700.

The mixer and game components may further be used for players who are non-readers, e.g., prekindergarten. In this regard, the instructor may instruct each player to find all the balls identifying his/her favorite color, and throw such balls 401 into the mixer.

For nonreaders, an instructor may also instruct each player to retrieve balls 401 having a particular color, e.g., red balls. Once the class has collected all the red balls, the students may throw the balls in the mixer.

The invention claimed is:

1. A game, comprising:

a mixer positioned at a first location on a gaming area, the mixer comprising a floor mat, a ball receiver opening, a ball disperser ramp, and a plurality of flexible poles coupled on their first ends to the floor mat and on their second ends to the ball receiver opening; and a plurality of balls randomly dispersed throughout the gaming area, each ball is inscribed with a letter;

a plurality of playing cards, each card indicating a word to be spelled, such that in response to a word on one of a selected playing cards, a player on a team collects one or more of the plurality of balls, once the balls are collected to spell the entire word, a score card is collected that indicates a point for the team, the player throws the collected ball(s) into the mixer, and the mixer disperses the collected balls back into the gaming area via the ball dispenser ramp, wherein the ball disperser ramp is two nettings coupled at an angle on a first end to the flexible poles, and on a second end the two nettings are coupled together.

2. The game apparatus of claim 1, further comprising a set of task cards positioned at a second location on the gaming area, wherein the commands are identified on the task cards, wherein a player selects a task card and collects one or more of the plurality of balls based on the command on the selected task card.

3. The game apparatus of claim 1, further comprising a set of word cards wherein the command based on one of the word cards.

4. The game of claim 1, wherein each of the plurality of balls comprises a letter in the alphabet such that each letter from the alphabet is representing on one or more of the plurality of balls.

5. The game of claim 1, wherein players on the team are instructed to collect from the plurality of balls one of the balls having a particular letter of the target word such that the collected balls spell the word.

6. The game of claim 5, wherein as each player collects the ball having the particular letter, the players place the collected balls on a building tray until the target word is spelled.

7. The game of claim 1, wherein the ball receiver opening is triangular.

8. A game, comprising a mixer positioned at a first location on a gaming area, the mixer comprising a floor mat, a ball receiver opening, a ball disperser ramp, and a plurality of flexible poles coupled on their first ends to the floor mat and on their second ends to the ball receiver opening; and a plurality of balls randomly dispersed throughout the gaming area, each ball inscribed with a letter;

a plurality of playing cards, each card indicating a word to be spelled, such that in response to a word on one of a selected playing card, a player on a team collects one or more of the plurality of balls, once the balls are collected to spell the entire word, a score card is collected that indicates a point for the team, the player throws the collected ball(s) into the mixer, and the mixer disperses the collected balls back into the gaming area via the ball dispenser ramp, wherein the ball disperser ramp comprises first netting and second netting, each extending in opposing directions in a slope.

9. The game of claim 8, wherein the mixer further comprises two flaps, the first flap is positioned to direct balls thrown in the ball receiver opening down the first netting, and the second flap is positioned to direct balls thrown in the ball receiver opening down the second netting.

10. A game, comprising:

a mixer positioned at a first location on a gaming area, the mixer comprising a floor mat, a ball receiver opening, a ball disperser ramp, and a plurality of flexible poles coupled on their first ends to the floor mat and on their second ends to the ball receiver opening; and a plurality of balls randomly dispersed throughout the gaming area, each ball inscribed with a letter;

a plurality of playing cards, each card indicating a word to be spelled, such that in response to a word on one of a selected playing card, a player on a team collects one or more of the plurality of balls, once the balls are collected to spell the entire word, a score card is collected that indicates a point for the team, the player throws the collected ball(s) into the mixer, and the mixer disperses the collected balls back into the gaming area via the ball dispenser ramp, wherein the ball disperser ramp further comprises:

a funnel coupled to the ball receiver opening; and a tube attached to the funnel.

* * * * *